US007170821B1

(12) United States Patent
Tonn et al.

(10) Patent No.: US 7,170,821 B1
(45) Date of Patent: Jan. 30, 2007

(54) DISPLACEMENT CURRENT METHOD AND APPARATUS FOR REMOTE POWERING OF A SENSOR GRID

(75) Inventors: David A. Tonn, Charlestown, RI (US); Paul Medeiros, Middleboro, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 261 days.

(21) Appl. No.: 10/901,311

(22) Filed: Jul. 23, 2004

(51) Int. Cl.
*G10K 11/00* (2006.01)

(52) U.S. Cl. ..... 367/141

(58) Field of Classification Search ..... 367/141, 367/903, 131
See application file for complete search history.

(56) References Cited

U.S. PATENT DOCUMENTS 4,201,079 A * 5/1980 Worcester ..... 73/40.5 R
4,982,385 A 1/1991 Eynck
5,267,221 A 11/1993 Miller et al.
5,608,692 A 3/1997 Toda
5,827,198 A 10/1998 Kassal
6,127,942 A 10/2000 Welle
6,490,228 B2 12/2002 Killam

* cited by examiner

*Primary Examiner*—Dan Pihulic
(74) *Attorney, Agent, or Firm*—Jean-Paul A. Nasser; James M. Kasischke; Michael P. Stanley

(57) ABSTRACT

This invention serves as a method and apparatus for delivering power to a series of remote sensors in an on hull sensor grid for the purpose of biasing the active circuitry on the sensors. It requires no physical connection between the source of power and the sensor. It works by delivering electrical energy across the insulating gap that separates the sensor from the hull by means of a displacement current. In particular, the method and device include a conducting layer interposed between inner and outer decouplers and a ground plane interposed between a bonding layer and the inner decoupler. An application of alternating current to the ground plane will activate the conducting layer and provide power to the sensors at a location of the outer decoupler. The inner decoupler acts as a capacitor and the ground plane further provides an electrical path back to the hull.

16 Claims, 2 Drawing Sheets

DISPLACEMENT CURRENT METHOD AND APPARATUS FOR REMOTE POWERING OF A SENSOR GRID

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates in general to the powering of remote sensors, and more specifically to a wireless power transmission system for use with a network of sensing devices.

(2) Description of the Prior Art

Currently, underwater vehicles have on-hull sensor arrays connected to the inboard side of the underwater vehicles, particularly large submarines, by means of large, heavy expensive wiring harnesses. The sensors are embedded in an acoustic polymer material and are located several inches above the hull of the underwater vehicle. There is currently a need for a means of delivering power to the sensor arrays arranged over the exterior of the hull of an underwater vehicle without the use of wired connections in order to reduce costs and the overall weight of the system, and to improve reliability. What is needed is a displacement current method and apparatus for the remote powering of a sensor grid.

SUMMARY OF THE INVENTION

It is a general purpose and object of the present invention to provide a method and apparatus that efficiently delivers power to a large array of remote sensors in an on-hull sensor grid.

It is a further object to power the large array of remote sensors without the need of heavy expensive wired connections.

These objects are accomplished with the present invention by delivering electrical energy across the insulating gap that separates the sensor from the hull by means of a displacement current. The exterior hull of an underwater vehicle includes a conducting layer interposed between inner and outer decouplers and a ground plane interposed between a bonding layer and the inner decoupler. An application of alternating current to the ground plane will activate the conducting layer and provide power to the sensors at a location of the outer decoupler. The inner decoupler acts as a capacitor and the ground plane further provides an electrical path back to the hull.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
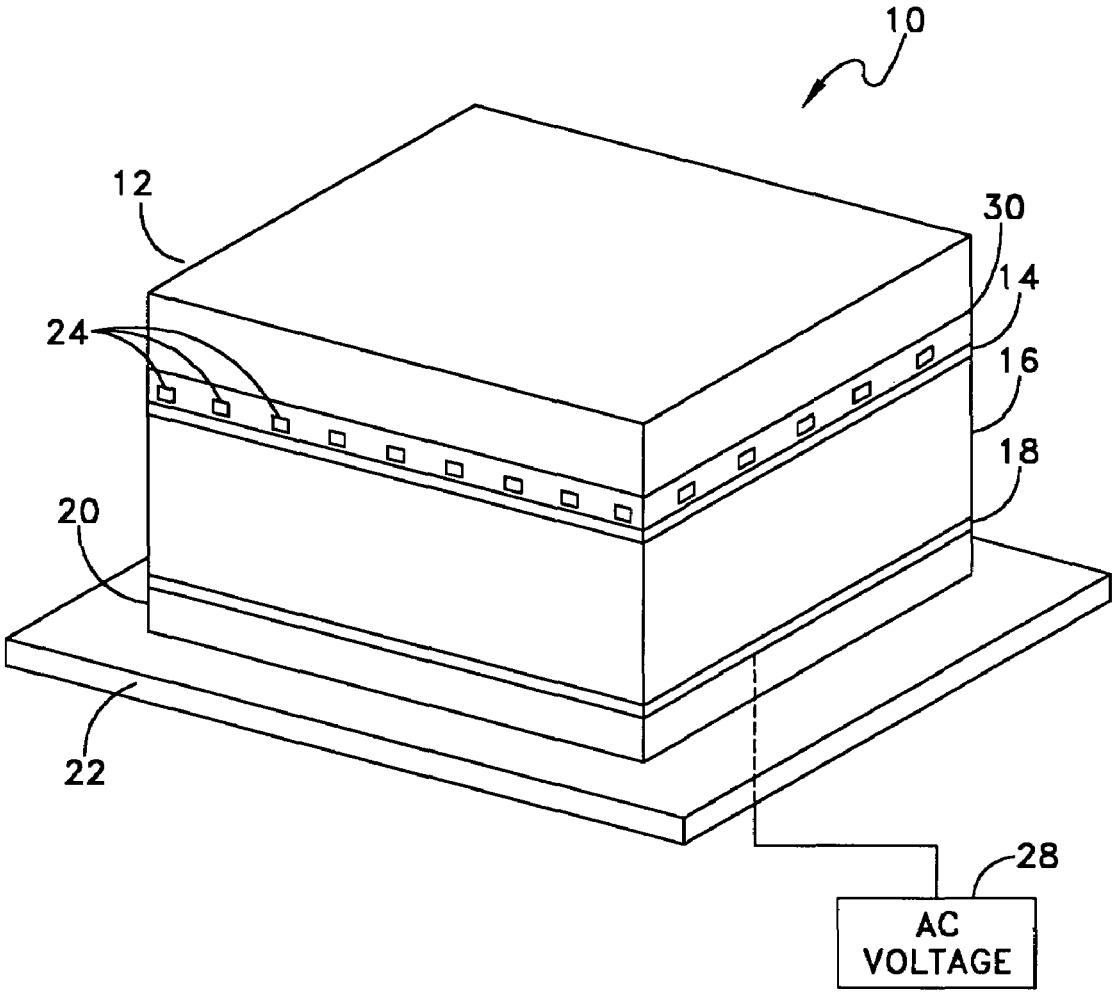
FIG. 1 is a depiction of a cross section of the materials stack in which sensors are embedded.

Referring now to FIG. 1, there is shown the materials stack 10 that the acoustic sensors 24 exist in, specifically an outer decoupler layer 12, an upper plate 14, an inner decoupler layer 16, a lower plate 18 and finally the bonding layer 20 that bonds the materials stack 10 to the hull 22 of the underwater vehicle (not shown). The inner and outer decoupler layers 12 and 16 should be made of an elastomeric dielectric insulator such as rubber or an acoustic polymer material that is urethane based. The upper plate 14 and the lower plate 18 layers should be made of metal such as aluminum, copper, silver or other highly conductive material and approximately 1 millimeter thick.

The sensors 24 are located directly above the boundary between the upper plate 14 and outer decoupler layer 12 and are in contact directly or indirectly with the upper plate 14. By stacking the layers in the manner illustrated in FIG. 1, specifically by having a conducting layer in the form of upper plate 14 between the inner decoupler 16 and outer decoupler 12, then the inner decoupler 16 can function as a capacitor. Power can then be delivered across the inner decoupler 16 that function as a capacitor by exciting a displacement current across the inner decoupler 16. This is accomplished by exciting an alternating current voltage of sufficiently high frequency from voltage source 28 on the lower plate 18 relative to the underwater vehicle's hull 22. A displacement current is established through the electrical path back to the underwater vehicle's hull 22 from the conducting layer or upper plate 14 between the inner decoupler 16 and outer decoupler 12.

In the preferred embodiment, it is assumed that a physical penetration of the inner decoupler 16 and the bonding layer 20 by structural members of the hull 22 exists. These sorts of penetrations are places of opportunity where a ground connection can be easily obtained either with or without a custom penetration. The hull 22 is assumed to be 0 volts at all times, making it the true ground of the system.

The sensor packages 24 are placed electrically in series with the upper plate 14. An alternating current voltage of sufficient frequency is induced on the upper plate 14 by the excitation of the lower plate 18. This voltage is rectified and filtered by the sensor packages 24, making a direct current voltage available for biasing of the RF payloads in the sensor packages 24. The rectifiers in the sensor packages 24 can be either half wave or full wave rectifiers. The ground connections of the sensors converge to the nearest available grounding point. In the preferred embodiment the sensors 24 tie into the nearest available grounding point through a bus connection to a ground distribution network 30 which connects electrically back to the hull 22 which serves as the ground. A bus connection is preferred to a ground plane, since the capacitance between the upper plate 14 and the lower plate 18 tend to create a voltage divider effect with the capacitance formed by the inner decoupler 16, reducing the efficiency of the powering scheme.

Figure 2:
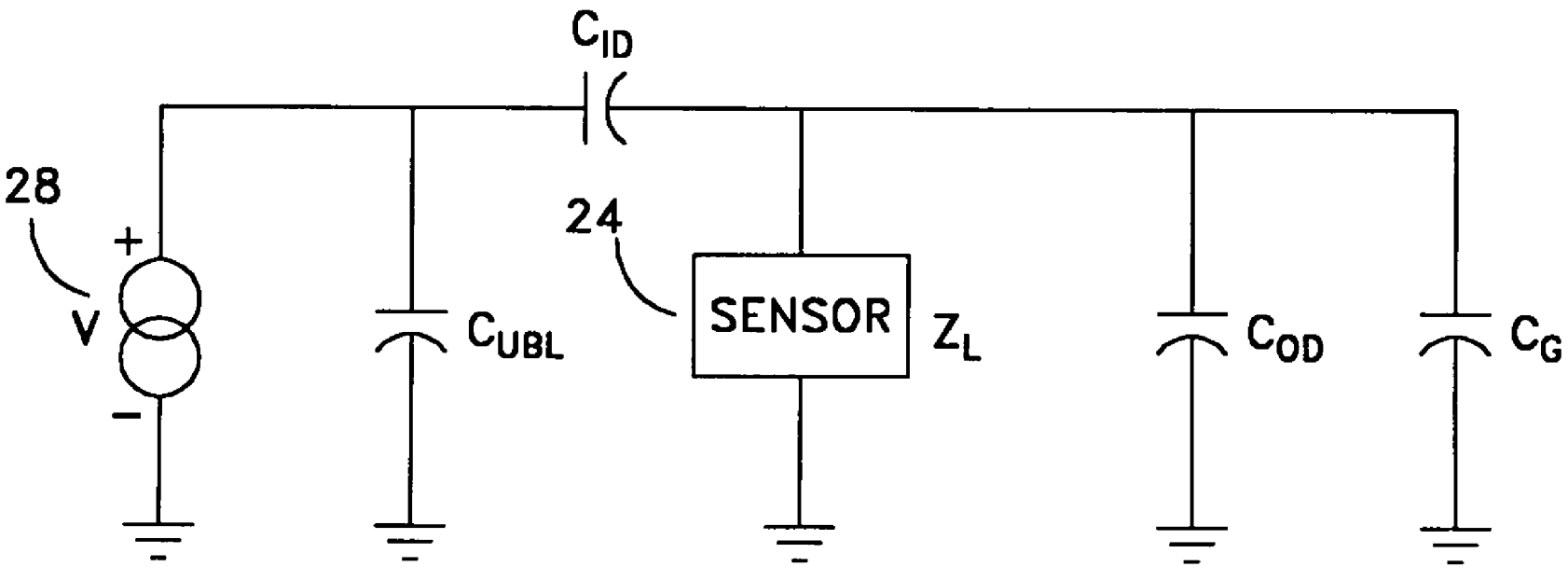
FIG. 2 shows a circuit diagram for the equivalent circuit of a network powered by displacement current.

An equivalent circuit of a network operating on displacement current is shown in FIG. 2. $C_{UBL}$ is the capacitance between lower plate 18 and the hull 22 through the bonding layer 20. $C_{ID}$ is the capacitance between lower plate 18 and upper plate 14 through the inner decoupler 16. $C_{OD}$ is the capacitance exhibited across the outer decoupler 12 between upper plate 14 and the seawater surrounding the underwater vehicle. $C_G$ is the capacitance between the upper plate 14 and the ground distribution network 30. $Z_L$ is the load impedance presented by the sensors 24. V is the voltage stimulus between lower plate 18 and ships hull 22.

The capacitance of $C_{UBL}$, $C_{OD}$ and $C_G$ are all parasitic to the network and should be minimized as much as possible. The voltage across $Z_L$, the load impedance presented by the sensors, is determined in phasor notation using circuit theory according to equation (1) as set out below:

$$V_L = \left(\frac{j\omega C_{ID} Z_{EQ}}{1 + j\omega C_{ID} Z_{EQ}}\right) V \tag{1}$$

where $$Z_{EQ} = Z_L \| \frac{1}{j\omega(C_{OD} + C_G)} \tag{2}$$

is the equivalent impedance formed by the parallel connection of the load impedance $Z_L$ and the two capacitors, $C_{OD}$ and $C_G$. The current flowing through the load $Z_L$ is:

$$I_L = \frac{V_L}{Z_L} \tag{3}$$

and since the power delivered to the load $Z_L$, then is:

$$P_L = \frac{1}{2} V_L I_L^* \tag{4}$$

using equations (1) and (4), the power can be expressed as:

$$P_L = \frac{|V|^2}{2Z_L^*} \left| \frac{j\omega C_{ID} Z_{EQ}}{1 + j\omega C_{ID} Z_{EQ}} \right|^2 \tag{5}$$

For the case when the capacitive reactance of $C_G$ and $C_{OD}$ are large compared with the load impedance $Z_L$, these terms do not contribute appreciably to the overall expression in (2) and the equivalent impedance is approximately equal to $Z_L$. Equation (5) then reduces to:

$$P_L = \frac{|V|^2}{2Z_L^*} \left| \frac{j\omega C_{ID} Z_L}{1 + j\omega C_{ID} Z_L} \right|^2 \tag{6}$$

Equation (6) bears some closer scrutiny. The power delivered to the load $Z_L$ is seen to be a familiar $V^2/Z$ term representing the maximum power that can be delivered if the generator was connected directly to the load and a modifying term that depends on the frequency of operation. However, for situations where:

$$\omega C_{ID} Z_L >> 1 \tag{7}$$

this modifying term approaches unity. This indicates that nearly total power delivery to the load is possible, almost as if the inner decoupler is not there at all. Theoretically, at least, nearly perfect power delivery efficiency is possible under ideal conditions, and that is the appeal that this method has.

The overall efficiency of the power delivery includes generator mismatches and the efficiency of the rectifier and filter stage in the sensors 24 that follows in order to convert the alternating current energy into direct current power used to drive the electronics packages in the sensors.

The advantage of the present invention over the prior art is primarily its simplicity in implementation and function. From this simplicity flows a savings in costs of materials for prior art wiring harnesses, time in implementation of wiring harnesses and time in maintenance. The invention also has a minimal impact on the acoustic properties of the overall system.

In light of the above, it is therefore understood that within the scope of the appended claims, the invention may be practiced otherwise than as specifically described.

What is claimed is:

1. An apparatus for remotely powering at least one sensor on the exterior of a surface, comprising:

a materials stack disposed over the exterior of the surface, in which said at least one sensor is embedded; and a means for generating an alternating current across said materials stack, thereby inducing capacitance in said materials stack, thereby causing a displacement current to flow to the at least one sensor.

2. An apparatus in accordance with claim 1 wherein said materials stack comprises:

a bonding layer disposed about the surface;

a lower conducting plate disposed over said bonding layer;

an inner decoupler disposed over said lower conducting plate;

an upper conducting plate disposed over said inner decoupler; and an outer decoupler disposed over said upper conducting plate, wherein said at least one sensor is embedded in the outer decoupler and is in contact with said upper conducting plate.

3. An apparatus in accordance with claim 2 wherein said means for generating an alternating current across said materials stack comprises:

an alternating current voltage source joined to said lower conducting plate capable of generating alternating current across said lower plate thereby inducing capacitance between the lower plate, the inner decoupler, and the upper conducting plate, thereby causing a displacement current to flow from the upper conducting plate to the at least one sensor.

4. An apparatus in accordance with claim 3 wherein the lower conducting plate disposed over said bonding layer is made of an electrically conductive material and approximately 1 millimeter thick.

5. An apparatus in accordance with claim 3 wherein the inner decoupler disposed over said lower conducting plate made of a dielectric insulator.

6. An apparatus in accordance with claim 3 wherein the upper conducting plate disposed over said bonding layer is made of an electrically conductive material and approximately 1 millimeter thick.

7. An apparatus in accordance with claim 3 wherein the outer decoupler disposed over said lower conducting plate made of a dielectric insulator.

8. An apparatus in accordance with claim 3 wherein the surface is a surface on the exterior of a hull of an underwater vehicle.

9. A method for remotely powering at least one sensor on the exterior of the hull of an underwater vehicle, comprising:

disposing a materials stack over the exterior of the hull of the underwater vehicle, in which said at least one sensor is embedded; and generating an alternating current across said materials stack, thereby inducing capacitance in said materials stack, thereby causing a displacement current to flow to the at least one sensor.

10. A method in accordance with claim 9 wherein said step of disposing a materials stack comprises:

disposing a bonding layer about the surface of the exterior of the hull of the underwater vehicle;

disposing a lower conducting plate over said bonding layer;

disposing an inner decoupler over said lower conducting plate;

disposing an upper conducting plate over said inner decoupler; and disposing an outer decoupler over said upper conducting plate, wherein said at least one sensor is embedded in the outer decoupler and is in contact with said upper conducting plate.

11. A method in accordance with claim 10 wherein said step of generating an alternating current across said materials stack comprises:

generating an alternating current across said lower plate thereby inducing capacitance between the lower plate, the inner decoupler, and the upper conducting plate, thereby causing a displacement current to flow from the upper conducting plate to the at least one sensor.

12. A method in accordance with claim 11 wherein the lower conducting plate disposed over said bonding layer is made of an electrically conductive material and approximately 1 millimeter thick.

13. A method in accordance with claim 11 wherein the inner decoupler disposed over said lower conducting plate made of a dielectric insulator.

14. A method in accordance with claim 11 wherein the upper conducting plate disposed over said bonding layer is made of an electrically conductive material and is approximately 1 millimeter thick.

15. A method in accordance with claim 11 wherein the outer decoupler disposed over said lower conducting plate made of a dielectric insulator.

16. A method in accordance with claim 11 wherein the surface is a surface on the exterior of a hull of an underwater vehicle.

* * * * *